United States Patent [19]

Szabo et al.

[11] 4,385,714

[45] May 31, 1983

[54] APPARATUS FOR AND METHOD OF SPREADING GASEOUS, LIQUID AND POWDERED MATERIALS

[76] Inventors: Miklos Szabo, Pasareti u. 75; Vilmos Weiperth, Dessewffy u.8/10, both of Budapest, Hungary

[21] Appl. No.: 210,151

[22] Filed: Nov. 25, 1980

[51] Int. Cl.[3] ..... B65D 83/06; B67B 7/24; B67D 5/54

[52] U.S. Cl. ..... 222/80; 222/82; 222/389; 239/309

[58] Field of Search ..... 239/309, 272, 271; 222/80, 82, 83, 83.5, 94, 95, 389, 401.24; 169/85

[56] References Cited

U.S. PATENT DOCUMENTS

| | | | |
|---|---|---|---|
| 2,559,091 | 7/1951 | Reasenberg | 239/309 X |
| 3,240,391 | 3/1966 | Garton | 222/80 |
| 3,819,002 | 6/1974 | Bonduris | 222/389 |
| 3,858,659 | 1/1975 | Fukushima | 239/309 X |
| 3,984,034 | 10/1976 | Cohen | 222/389 |

FOREIGN PATENT DOCUMENTS

| | | | |
|---|---|---|---|
| 2115035 | 10/1972 | Fed. Rep. of Germany | 239/309 |

*Primary Examiner*—Andres Kashnikow
*Attorney, Agent, or Firm*—Young & Thompson

[57] ABSTRACT

The invention relates to an apparatus for and a method of spreading gaseous, liquid and powdered materials, that are applicable to pressing out creamy or foamy materials, too. According to the method a material to be spread is placed in a tank into the pressure vessel, overpressure is developed in the pressure vessel for spreading, whereby the tank moves towards the spreading nozzle and the spreading nozzle is communicated with the interior of the tank. The apparatus comprises a pressure vessel with its interior space divided into two sections, one of them contains the fuel tank ensuring the overpressure, the other one contains the material tank sealing airtightly the first section. The invention provides reliable spreading, not polluting the environment, the pressure vessel of the apparatus is not to be thrown away, and the tanks inside the vessel are replaceable.

3 Claims, 1 Drawing Figure

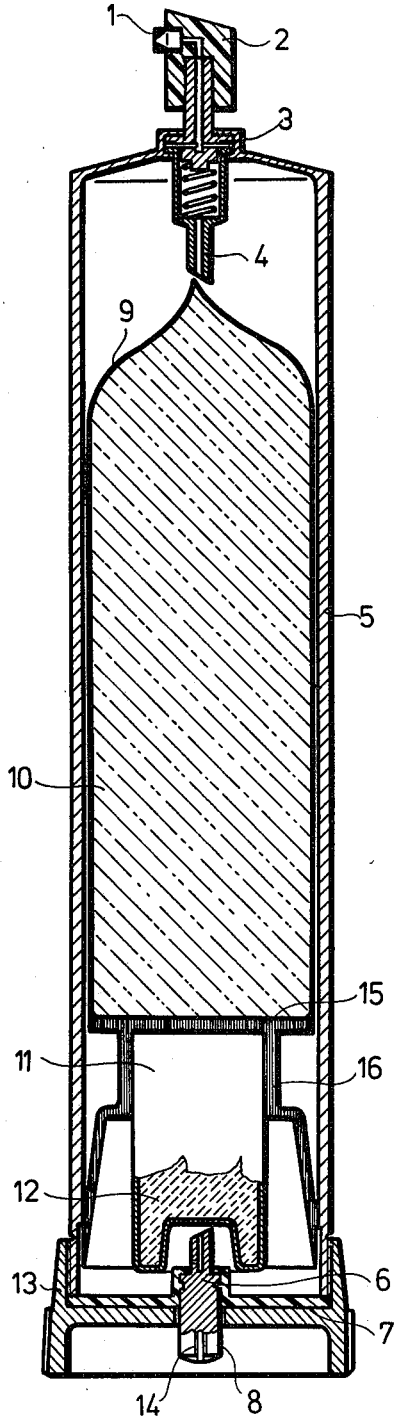
1
2
3
4
9
5
10
15
11
16
12
13
6
7
14
8

APPARATUS FOR AND METHOD OF SPREADING GASEOUS, LIQUID AND POWDERED MATERIALS

The object of the present invention is an apparatus for and a method of spreading gaseous, powdered materials and those of liquid state. In the following description the liquid materials include also the creamy and foamy materials of relatively low viscosity that may be pressed out by using the proposed apparatus or method.

The method according to the present invention affords spreading or pressing out the mentioned materials safely, using fuel materials for developing overpressure which do not pollute the environment and avoid propellants used hitherto, while the apparatus can be repeatedly reused owing to the replaceable inner parts, can be manufactured inexpensively in comparison to the known devices and is of long life. The apparatus does not need skill in handling.

Several methods and apparatus are known for spreading and pressing out materials. The siphon and the so-called aerosol products are the best-known of them. Their common feature is that they have a pressure vessel for containing material to be spread wherein overpressure is developed by a proper material, namely by carrier gas (so called propellants). The overpressure is used for spreading or pressing out the material filling up the pressure vessel through a valve that opens in the desired direction.

The propellant enters the pressure vessel of the siphons from outside, from a replaceable tank. The pressure vessel can be repeatedly reused, the material to be spread can be repeatedly refilled. This construction is preferable if material of a respectable quantity is to be prepared for spreading or especially preferable if chemical reaction is required between the material to be spread and the propellant providing overpressure.

A characteristic of the aerosol products is that their material to be spread and the propellant are filled in the tank under overpressure. Another characteristic is that refilling them being very complicated they are generally products for single use, and they have to be thrown away after use.

The aerosol products comprise fluorohydrocarbons such as those trademarked Freon, Frigon, Kaltron, etc., as propellants. The fluorohydrocarbons are chemically inert and as inert gases would be very advantageous. Their environment pollutant effect, and the eventual decomposition of the ozone shield of the atmosphere in their presence are widely investigated, the use of hydrocarbons, however, has been already banned in many countries on account of their presumed negative consequences. This tendency is expected to spread throughout the world. Wide range experiments for replacing hydrocarbons are being made, but a material being similarly inert, cheap with favourable features of use has not been found up to now. Generally the other propellants are relatively expensive or their chemical reaction with the material to be spread is unfavourable for use.

Apart from the propellant being eventually dangerous for the environment, the aerosol products are relatively expensive: the high cost of the container is not commensurate with the value of the material to be spread, and their single use feature owing to safety requirements significantly increases the cost of production. In case of material to be spread being incendiary or of explosive risk, the empty vessels require special care, because the material left behind inevitably in the vessel may cause accidents when opening the vessel carelessly.

The methods of and apparatus for refilling the aerosol vessels are complicated and not hygienic and moreover do not prevent the content of the vessel from getting into the atmosphere, in this way further polluting environment. Another drawback is that the refilled vessel can not be sealed safely but by employing more expensive materials and constructions further increasing costs.

An object of the present invention is to provide a method of and apparatus for spreading materials without polluting the environment and which is cheaper than all the known methods, eliminating the drawbacks mentioned above. Another object is to provide a method and apparatus that can be repeatedly used, is unexpensive, operated by fuel not polluting the environment, and whose handling does not require skill.

The invention is based on the perception that the known pressure vessel also can be used for spreading material in such a way, that propellant (fuel) and material to be spread, prepared separately in a cheap container, that can be thrown away, can be placed into it. If the fuel is packed under overpressure, then the material tank containing the material to be spread can be opened inside the pressure vessel and then the material can be spread safely.

There is provided a method for spreading gaseous, liquid and powdered materials, comprising the steps of placing the material to be spread in a tank into a first space section of a pressure vessel adjacent to a spreading nozzle, placing a fuel in a tank into a second space section of the pressure vessel remote from the spreading nozzle, developing overpressure in the second space section, hereby lessening the volume of the first space section and connecting the first space section to the spreading nozzle according to need, for spreading.

Another object of the invention is an apparatus for spreading gaseous, liquid and powdered materials, comprising an airtight sealed pressure vessel having a first and a second space section, a spreading nozzle connected to the first space section and preferably having a valve, a fuel tank placed in the second space section, and filled under overpressure, a mechanism for pricking the fuel tank connected to the second space section, and a material tank containing the material to be spread placed in the first space section.

Preferably, the material tank of the apparatus according to the present invention provides airtight sealing for the second space section containing the fuel and it simultaneously bears against the wall of the pressure vessel ensuring sliding.

Preferably, the pressure vessel comprises a valve communicating with the anterior space.

Preferably, the first space section of the apparatus comprises a proper mechanism, for example an inlet tube communicating with the spreading nozzle, for pricking the material tank.

Highly preferably, the second space is sealed by an end cap secured with a screw-thread or a bayonet-lock or otherwise properly secured, and the end cap comprises the evacuation valve, the pricking mechanism, preferably comprising a pricker.

By the method and apparatus according to the present invention powdered, gaseous materials and those of proper viscosity can be effectively spread, atomized or pressed out without polluting environment. Compressed air or other similarly cheap, easy to sell gas can be used as fuel, as it does not come into contact with the material to be spread. If desired, a two-component chemical system can also be used as fuel. There is no need for throwing away the pressure vessel after use, new tanks of fuel and material to be spread can be placed into it, and the apparatus can be put into service very simply. In this way a new commercial family of goods can be developed incorporating interchangeable members.

The present invention will now be described, by way of example, with reference to the accompanying drawing, wherein the FIGURE is a cross-sectional view of the apparatus according to the present invention.

Different methods according to the present invention can be provided. Basically a pressure vessel is suggested comprising a spreading nozzle with valve. As the lower end cap of the vessel is removed, the separated material tank is placed into it, next to the spreading nozzle, and the fuel tank is placed on the top of the material tank. The material tank is used for closing the path of the gas in the direction of the spreading nozzle. As the end cap is screwed on or otherwise sealing is provided, the opening of the material tank is ensured by a pricking mechanism. The developed overpressure moves the material tank towards the spreading nozzle. The spreading nozzle may be, for example, a valve comprising an inlet tube and the tube rips the wall of the tank and as it sinks into the material tank at the same time, the opening of the valve enables spreading.

Another obvious method is that after pricking the material tank and opening the valve, a pricker or other sharp member situated in the space of the material tank effectuates the ripping of the material tank in the pressure vessel sealed as described above. In this method the valve can be omitted, the material exits immediately in the desired direction as soon as the material tank is ripped.

Another method is that the pressure vessel is divided into two parts and their sealing effectuates both the air-tight sealing of the pressure vessel and the opening of the fuel tank. A movable dividing wall is effected between the two parts, and the spreading nozzle of the material tank is covered with a layer of easily rippable material. This way a spreading device suited for single use with single assembly, comprising a spreading nozzle ripped under the overpressure developed by opening the fuel tank is obtained.

The methods described above naturally do not embrace all the possible methods according to the present invention. Those skilled in the art working on the basis of the above and following instructions can draw up a number of different designs each of them realizing the basic idea of the invention.

The base of the apparatus also suitable for carrying out the proposed method is a pressure vessel 5 sealed on one side by a spreading nozzle, a valve mechanism, in this case comprising an exit tube 4, a valve 3, and an atomizer 1 supported by a fingerpiece 2, and on the other side by an end cap 13. The end cap 13 connects to the pressure vessel 5 through packing 7 and is secured to the vessel with a screw thread, bayonet-lock (not shown in the FIGURE) or other proper mechanism. The end cap 13 comprises an evacuation valve 14 communicating with the internal space of the pressure vessel and a pricking mechanism comprising a pricker 6 and a push button 8.

The steps of operating the apparatus of the present invention are provided as follows.

A material tank 9 containing a material 10 to be dispensed is placed into the pressure vessel 5. The wall of the material tank 9 next to the end cap 13 is pressure-tight while its wall next to the spreading nozzle and to the valve mechanism, respectively, can be easily ripped. The wall next to the end cap 13 can be a stiff wall 15 or an elastic wrapper 16 bearing tightly against and guided by the inside wall of the pressure vessel (shown in the FIGURE). After the material tank 9 has been inserted, a propellant tank 11 containing a propellant 12, for example, compressed air, is inserted. The pressure vessel 5 is sealed by the end cap 13. After sealing the pricker 6 is pricked into the wall of the propellant tank 11 by pressing the push button 8. The energizing propellant 12 presses the stiff wall 15 or the elastic wrapper 16 of the material tank 9 against the wall of the pressure vessel 5 and hereby blocks its own further passage. As a result of the developed overpressure the material tank 9 moves towards the spreading nozzle and in this case it is pricked by the wall of the inlet tube 4 whereupon a communication is effected between the spreading nozzle and the internal space of the material tank 9. Upon opening the spreading nozzle by pressing on fingerpiece 2, the material 10 to be spread, contained in the material tank 9 is forced by the overpressure to exit through the atomizer 1 transformed into tiny drops. As the material tank 9 keeps deflating, the pressure moves the wall dividing the internal space of the pressure vessel 5 always more and more against the spreading nozzle. As soon as the material tank is empty the propellant 12 left is removed by using the evacuation valve 14 and the deflated tanks in the pressure vessel 5 can be removed by opening the end cap 13 and can be replaced by new ones.

The method according to the present invention enables an effective apparatus to be built with remarkably inexpensive, simply manufactured elements. The tanks can be thrown away after use, the fuel used can be selected from inexpensive gases not polluting the natural environment, the apparatus is explosion- and fireproof even in case of violent effects. The material tanks can be filled with materials of various kinds.

The apparatus and method according to the present invention provide prefabricated material tanks of pleasing and diversified exterior for dispensing, and their content can be checked easily and without errors. It should be noted, that the material tank may contain the fuel tank for providing easier sale, transport and use. The invention results in a 50–80 percent decrease in cost compared to the conventional constructions. The encasement of the tanks, that may be thrown away, is of small size and the apparatus much less pollutes the environment than the previous constructions.

What we claim is:

1. Apparatus for dispensing material, comprising a casing, a first sealed container of the material to be dispensed disposed within said casing, a second sealed container of propellant also disposed within said casing, means to close said casing, means operable through said closing casing to pierce the second container thereby to apply the pressure of the propellant to the outside of said first container without admixing the propellant with the material to be dispensed, and means to dispense said material from the interior of said first container under the pressure of said propellant to a point outside said casing, said first container being movable in said casing under the influence of the pressure of said propellant, piercing means within the casing to pierce the first container when the first container moves toward the piercing means under the impetus of said propellant, said dispensing means comprising a dispensing valve for dispensing material from the pierced first container.

2. Apparatus as claimed in claim 1, and an end closure cap on the casing, said end closure cap being removable and said first and second containers being replaceably removable within said casing when the end closure cap is removed.

3. Apparatus for dispensing material, comprising a casing, a first sealed container of the material to be dispensed disposed within said casing, a second sealed container of propellant also disposed within said casing, means to close said casing, means operable through said closed casing to pierce the second container thereby to apply the pressure of the propellant to the outside of said first container without admixing the propellant with the material to be dispensed, and means to dispense said material from the interior of said first container under the pressure of said propellant to a point outside said casing, and wall means separating said first and second containers within the casing, the propellant moving said wall means toward the first container when the second container is pierced and the propellant is released within the casing, said second container being movable with said wall means.

* * * * *